US005655289A

United States Patent [19]

Wille et al.

[11] Patent Number: 5,655,289

[45] Date of Patent: Aug. 12, 1997

[54] BLIND-RIVET SETTING DEVICE

[75] Inventors: Lothar Wille; Hubertus Klein, both of Mörfelden-Walldorf, Germany

[73] Assignee: GESIPA Blindniettechnik GmbH, Frankfurt am Main, Germany

[21] Appl. No.: 340,121

[22] Filed: Nov. 15, 1994

[30] Foreign Application Priority Data

Nov. 16, 1993 [DE] Germany ..... 43 39 117.6

[51] Int. Cl.[6] ..... B23P 21/00

[52] U.S. Cl. ..... 29/703; 29/715; 29/720; 29/243.53

[58] Field of Search ..... 29/407, 407.01, 29/407.05, 525.06, 702, 703, 705, 707, 715, 720, 243.53, 243.54

[56] References Cited

U.S. PATENT DOCUMENTS

| | | | |
|---|---|---|---|
| 4,163,311 | 8/1979 | Sigmund | 29/407.02 |
| 5,105,719 | 4/1992 | Yoshikawa | 91/59 |
| 5,196,773 | 3/1993 | Yoshikawa et al. . | |
| 5,212,862 | 5/1993 | Eshghy | 29/407.03 |
| 5,219,375 | 6/1993 | Kamata et al. . | |
| 5,398,537 | 3/1995 | Michalewski et al. | 29/243.54 |

FOREIGN PATENT DOCUMENTS

| | | |
|---|---|---|
| 0454890A1 | 11/1991 | European Pat. Off. . |
| 0594333A1 | 4/1994 | European Pat. Off. . |
| 41 26 602 C2 | 6/1993 | Germany . |
| 2-229639 | 9/1990 | Japan . |
| 4-17935 | 1/1992 | Japan . |
| 4-94126 | 8/1992 | Japan . |
| 4-284937 | 10/1992 | Japan . |

OTHER PUBLICATIONS

Vogel, Johannes: Grundlagen der elektrischen Antriebstechnik mit Berechnungsbeispielen, 4.Aufl., VEB–Verlag Technik, 1989, pp. 254–257 (Elementary electrical drive–technique with computation examples, 4th edition, etc.).

*Primary Examiner*—David P. Bryant
*Attorney, Agent, or Firm*—Darby & Darby

[57] ABSTRACT

A blind-rivet setting device, includes a tension device, an intermediate storage and computing device, an evaluation device and an electrical circuit. The tension device is driven by an electric motor having an input current and provides a tensile force on the blind-rivet. The intermediate storage and computing device stores and computes a rated current range depending on the material and dimensions of the blind-rivet. The evaluation device has a comparator for monitoring the input current received by the electric motor. The electrical circuit produces an error message when the maximum value of the input current is not within the rated current range.

8 Claims, 1 Drawing Sheet

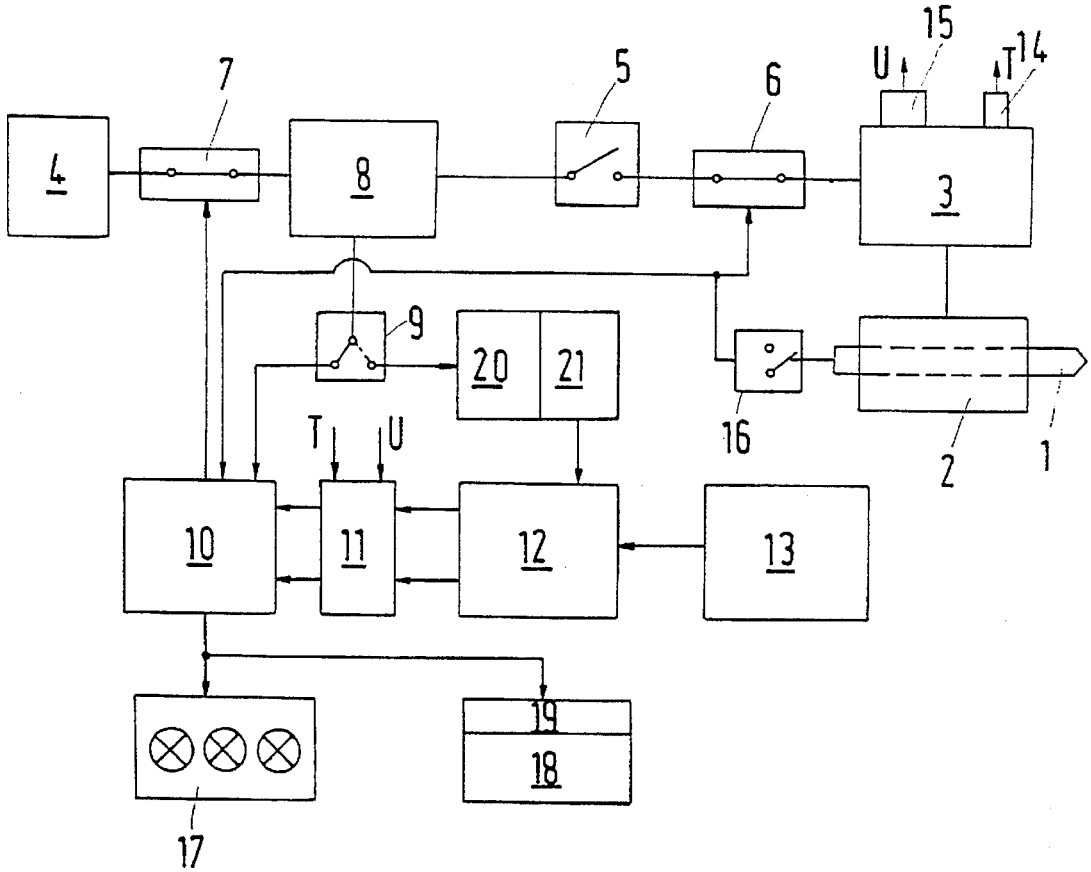
4
7
8
5
6
U
15
T
14
3
9
20
21
16
2
1
T
U
10
11
12
13
19
18
17

BLIND-RIVET SETTING DEVICE

FIELD OF THE INVENTION

This invention relates to a method and device for setting blind-rivets and blind-rivet nuts, and more particularly to a setting procedure and device wherein a tension force is produced by a tension mechanism which is driven by an electric motor.

BACKGROUND OF THE INVENTION

A typical setting device and method for setting are disclosed by DE 41 26 602 A2. It should be noted that the term "blind rivets" also includes "blind-rivet nuts" unless they are mentioned separately. In the setting of the blind-rivets, a statement disclosing the quality of the connections produced by the blind-rivets is desirable or in many cases even required. It should be ascertained that the blind-rivet was set with the required strength. If the tension utilized to set the blind-rivet was too small, there is the danger that the riveted connection was not produced with the necessary force and will be inferior. If the tension was too large, there is the danger that the material was damaged or in the case of the blind-rivet nuts, that the thread was damaged.

European Patent EP 0 454 890 A1 discloses a power measuring device provided in the device's tension mechanism to assure that the rivet setting device operates with a predetermined tension when utilizing transmitting devices such as electrical, hydraulic, pneumatic or hydraulic-pneumatic setting devices. The power measuring device may be in the form of a tension measuring strip or a pressure box, both of which transform the mechanical pressure to an electrical value. The evaluation and monitoring of the setting process is done electrically by comparing the achieved measured power values with established nominal values in databanks. The disadvantage with this arrangement is that the tension measuring strip or pressure box needed for gathering the data of the forces represent added elements which require additional cabling or wiring costs. Furthermore, these elements must be arranged on the tension mechanism, which makes it necessary to disassemble the elements for daily maintenance of the riveting device, thus increasing maintenance costs. There is also the danger that the measuring devices or measuring lines can be damaged. A number of factors will influence the evaluation of the measuring results when using tension measuring strips. These factors include sizes (diameters), tolerances of the tension device, fluctuations of the coefficient of elasticity of the materials between various finishing stages and temperature influences.

U.S. Pat. No. 5,105,719 discloses a hydraulic riveting device for the positioning of a tool which forms a rivethead in a riveting machine. In this machine, a forming-tool is actuated by a hydraulic cylinder. The hydraulic cylinder is connected to a motor by means of a ball-thread drive which, in turn, is connected to a regulator. The moment created by the motor, as well as numerical values of the motion and the velocity of the motor motion, are entered in the regulator. The regulator simultaneously controls the hydraulic pressure needed for the hydraulic cylinder so that the moment produced by the motor remains zero.

Johannes Vogel describes current-regulator fed DC and 3 phase AC drives in the publication entitled *Grundlagen der elektrischen Antriebstechnik mit Berechnungsbeispielen*, 4.Aufl., VEB-Verlag Technik, 1989, page 254–257 (Elementary electrical drive technique with computation examples, 4th edition). There are also several examples for feedback of information of current or other regulators.

European Patent EP 0 594 333 A1 describes a setting device for blind-rivets which is monitored during the loading of the motor. After the tension device has achieved a certain value, a moderate load must be attained. If this is not the case, the device is stopped because a problem is suspected.

SUMMARY OF THE INVENTION

It is therefore an object of the invention to achieve the monitoring of the setting process without changing the mechanical construction with electrically operated setting devices.

The invention achieves this object with the initially named method, to have a rated current range for the input current depending upon the material and dimensions of the blind-rivets and blind-rivet nuts. The method is selected and monitored if the actual input current reaches a maximal value during the setting process which lies in this rated current range.

Using an electric motor, the received current is a direct measurement of the moment or torque produced by the motor. It is not necessary that the relationship between the moment produced and the input current be linear. It could, for example, be quadratic. Regardless, each input current has a moment assigned to it and vice-versa. As a rule, the motor drives the tension mechanism by means of a drive with a known transmission ratio so that the moment produced by the motor can be calculated in terms of tension, using a relatively simple method. The tension which develops during the setting process, especially the maximum value of the tension, allows the quality of the riveted connection to be determined. Since the transmission ratio between the motor and tension device does not change, the tension does not have to be determined directly. It is sufficient to know the moment which was produced in the setting of the blind-rivet. This moment can also be determined from the input current. Losses which are created by friction in the setting device are negligible in most cases. These losses could be considered appropriately in cases where the losses reach considerable magnitudes with respect to the setting force. The evaluation of the current input is relatively easy to determine. With most setting devices for blind-rivets which are electrically driven, there is a regulator add electronic control system provided that would require expansion to measure the current. No additional mechanical or electrical measurement collecting elements, such as pressure transducers or tension measuring strips, are required as these would be potential hazards. The information in the device, namely the current distribution, is used as the criteria for the evaluation of the setting process. Essentially, the entire current distribution is monitored during the setting process. From the force path process, only the maximum value is important to determine if the setting process was accurate. With blind-rivets, the maximum value occurs in the moment of the riveting mandrel breakdown. With blind-rivet nuts, the maximum value occurs at the end of the setting process. If the maximum value is not large enough to be within the rated current range, it is a sign of a faulty riveting or of a faulty setting device. This may be caused by a worn gripper which has slipped from the mandrel of the tension device or may be a rivet which was applied with too little setting power. If the maximum value is too large, this will result in increased friction in the setting device which was caused by contamination or the improper selection of a rivet and could damage the connected parts. In both situations, the proper error messages can be issued and thereby, warn the user.

In a preferred embodiment, the rated current range can be compensated for temperature or input voltage. The relationship between the input current and the moment produced by the motor is in some cases dependent on the temperature and/or the input voltage. If the motor should heat up during operation, the temperature increase will not cause any superfluous error messages due to using temperature compensation. The same is true for the input voltage, especially with battery or storage battery powered motors, where the input voltage during operations drops depending on the charge condition.

In order to establish the rated current range in an advantageous arrangement, the invention provides the input current range which is determined by at least one trial riveting under conditions comparable to an actual riveting. This is arranged on a sample part so that the needed input current is measured. The quality of these trial rivetings can be checked with a destructive material test and with the determined value of the maximum current, set at a fixed rated current range which can be used with subsequent actual rivetings.

Establishing the rated current range is even simpler when calculated during trial riveting as the current distribution or at least one of the derived values is stored and later used for the production of the rated current range. In this case, the current distribution or the derived value is recalculated and again entered. In addition, the current distribution or the derived value can be directly stored and later used for the production of the rated current range.

In a preferred embodiment, the current supply to the motor is interrupted as soon as the current input reaches a predetermined maximum value. Such a mode of operation is particularly advantageous during the setting of the blind-rivet nuts. This assures that when reaching the predetermined maximum value, the blind-rivet nuts are fastened with the required force. Furthermore, the maximum value limits the tension force and thereby prevents damage to the thread.

Preferably, the given temperature and/or input voltage compensated current distributions or their derived values are stored by successive setting processes. In many production ranges, a connection of two or more parts occurs not only around a riveting but also over multiple rivetings. It is then possible, due to the storing and subsequent evaluation of the stored results, to state if a sufficient number of rivet connections have the required quality. Beyond this, the maintenance requirements of the device can be specified by continuous storing of the current distribution or derived values. If the maximum value continuously rises, it is an indication of increasing contamination. However, if the maximum values repeatedly do not reach the nominal values, it is an indication that the tension mechanism, particularly the gripping mechanism, is worn out.

In a preferred embodiment, the input current distribution or their derived values can be classified and stored simply by numbers of events per class. This substantially reduces the storage use without the loss of essential information. The invention achieves this object with a setting device in the initially mentioned way, by providing an electrical circuit featuring an evaluation device with a comparator to monitor the current distribution of the motor, which is connected to a current measurement device.

As mentioned above, the current directly received by the motor gives evidence of the power exerted by the tension device, which in turn gives information about the quality of the riveting connection or the seating of the blind-rivet nut. The evaluation device could record the quality immediately after each setting process, for instance, as satisfactory or unsatisfactory. It can also indicate a failure of the setting device or the necessity for maintenance or repair. It is not necessary that the input current receive evaluated numbers or values continuously. It needs only to monitor the input current based on a certain threshold value. If this threshold value is reached, it is an indication that the setting process was satisfactory.

In a preferred embodiment, the comparator is connected to a threshold value indicator which comprises a nominal value storage device and compensation device and shows at least two threshold values preselected from the outside. One could select the threshold values depending on the rivet material used and/or the size of the rivet. For example, blind-rivets made from aluminum require a different tension force than those made of steel. The new possibility, to select several threshold values dependent on the blind-rivets to be set, makes the setting device useable for a variety of blind-rivets.

In this situation, it is preferred to provide a motor temperature measuring device and/or a motor voltage meter with connections to the threshold value indicator. The threshold value indicator changes the pre-selected threshold value, depending on the motor temperature and/or the motor input voltage. The threshold value for a certain motor temperature and/or the motor input voltage are the only given values. If the temperature or the motor input voltage changes, the threshold value will be adjusted correspondingly. For this purpose, the threshold value indicator could store the characteristic relations between the moment, the input current, the temperature and input voltage in the form of curves or tables.

In a preferred embodiment, the threshold value indicator provides a storage device which stores various threshold values. Every threshold value corresponds to a certain combination of material and size of the blind-rivet.

It is especially preferred that the storage device be connected to a readout device which provides a peak current meter in the form of a current measurement device, an intermediate storage for filing several peak current, and a computing device for determining a mean value and/or a tolerance-band from the stored peak current values. This provides a simple method for the required threshold value to be determined in the rivet connections during trial riveting. This threshold value can be stored with a predetermined tolerance-band in the storage device. The resulting threshold value can be retrieved at a later time and used if a similar rivet connection is to be produced.

It is advantageous to have the comparator designed as a window comparator. In this case, two threshold values or a single threshold value couple are needed to form a window which represents the nominal value range. The maximum value of the current determined during the setting process must lie in this window. If the value is too small, then the setting process was not carried out with sufficient force. If the value is too large, then the setting device was contaminated, damaged or a wrong blind-rivet was used.

In a preferred embodiment, a position-sensor for the tension device, connected to the evaluation device, is provided. With the aid of the position-sensor, the current distribution can be established at characteristic points or the position-sensor can be used to establish whether a predetermined current value was reached within a certain motion range.

In a preferred embodiment, the position-sensor is designed as a limit switch. Thus, during the setting process, it can be determined if the required current maximum was attained before reaching the final position.

BRIEF DESCRIPTION OF THE DRAWINGS

The Single FIGURE shows a schematic drawing of a switching arrangement of the preferred setting device.

DETAILED DESCRIPTION OF THE INVENTION

Referring to the Single FIGURE, a setting device for blind-rivets and blind-rivet nuts shows a schematic tension mechanism 1 which is driven by an electric motor 3 by way of a drive 2. The electric motor 3 is fed by a voltage source 4 while a service switch 5 is closed by an operator. A first switch 6 and a second switch 7 are positioned in a row between the voltage source 4 and the motor 3. Their function is more clearly described below. In addition, a current value meter or measurement device 8 is located between the motor 3 and the voltage source 4. In the simplest case, this can be provided as a current-voltage transformer. The current measurement device 8 may contain an analog/digital transformer which makes the current values available in digital form.

The current measurement device 8 is connected by a switch 9 to the entrance of a window comparator 10. The window comparator 10 is also connected through a compensation device 11 with a nominal value storage 12 which can be controlled by a keyboard 13. The motor 3 has a temperature sensor 14 and a voltage-meter 15 which are connected with the compensation device as shown by lines T and U. The window comparator 10 is connected to the second switch 7, which opens upon receiving a signal from the window comparator 10. The tension mechanism 1 closes a limit switch 16, which opens the first switch 6 and relays a corresponding signal to the window comparator 10. The window comparator 10 is connected to an indicator device 17 and a result storage 18, which can have a classification device 19 connected to it in series. The switch 9 has two different terminals, the first is on the side connected to the window comparator 10 and the second is connected to an intermediate storage 20, a computing device 21 and the nominal value storage 12.

In operation, using the keyboard 13, a nominal value pair is selected from the nominal value storage 12 according to the size and material of the blind-rivet and blind-rivet nuts to be set. This nominal value pair can be entered beforehand into the keyboard 13. It is also possible that the nominal value pair, which defines a rated current range, is loaded into the nominal value storage 12. With one or several trial rivetings, the nominal value pair shifts the switch 9 into the dotted position as shown by the Single FIGURE. During the trial riveting, the measured current distribution of the motor 3 is measured with the aid of the current measurement device 8 and loaded into the intermediate storage 20. In many instances, it will suffice to load the maximum value of the current in the intermediate storage 20. The computing device 21 calculates the rated current range from the derived values during trial riveting, which means it determines the upper and lower limits of the rated current range for a particular kind of riveting. This rated current range will then be loaded in the nominal value storage 12 in a position which was selected beforehand using the keyboard 13. There are a large number of possibilities for the fixing of the rated current range. For instance, a computing device 21 can formulate the mean value from the stored values in the intermediate storage. From this mean value, the upper and lower limit of the rated current range is created by adding or subtracting the tolerance value. The tolerance range can also be determined by evaluating the spreading during trial riveting.

The value pair reading obtained from the nominal value storage 12, which defines the rated current range, is loaded into the compensation device 11. The compensation device 11 computes the rated current range in relation to the motor temperature T and the motor voltage U. This enables the window comparator 10 to receive the threshold values which correspond to a current range, a prevalent motor temperature T and the actual motor voltage U required to exert the proper tension on the blind-rivet and the blind-rivet nuts.

Regarding the keyboard 13, the mode of operation can also be selected, for example, if blind-rivet or blind-rivet nuts are to be set. In the case where blind-rivet nuts are set, other evaluation criteria should be partially considered. To avoid tearing of a riveting mandrel, and consequently a stroke-like drop of the motor current during the setting of the blind-rivet nuts, a maximum current is defined which must be reached. However, the maximum current cannot be appreciably surpassed if a setting process is to achieve the required quality.

This maximum current is also naturally dependent on the blind-rivets which are used, especially regarding size and material. In this case, the window comparator 10 signals a start to the second switch 7 when the lower threshold value is reached. The second switch 7 opens and interrupts the setting process. Since the interruption takes place exactly at the instant of the highest moment and also the highest power, it is assured that the blind-rivet nuts are set with adequate strength. Since the maximum current is limited, any tearing of the thread is prevented.

With all setting processes, the limit switch 16 can also be used to aid the monitoring of the setting process. With blind-rivet nuts, the maximum current must be reached before the limit switch 16 is actuated. In addition, a tension path can be predetermined, for example, by using adjustable stops. In this case, the maximum value must be substantially reached if the limit switch is actuated. It could then be established, by actuating the limit switch, whether the current value lies in the range of the nominal current.

By use of a result storage 18, several evaluations can be performed. For example, information about the maintenance needs of the setting device can be received. Should the maximum current values of the setting device rise during this time, it may be caused by increasing contamination of the device. This contamination may cause higher friction and an increased need for power of the motor. If there is a large number of rivetings, where the nominal current range was not reached, this will result in substantial wear of the gripper mechanism. In this case, the gripper mechanism slips from the rivet without having the rivet set properly.

In many cases, it is not necessary to store the maximum value at each time. One can separate the maximum values into several classes by using a classification device 19 and store merely the number of events per class in order to save storage space. In the simplest case, three classes would suffice, namely one class in which the rated current range was not achieved, one class which was within the rated current range, and another class in which the values are above the rated current range. Through refining the distribution of the rated current range into various partial ranges, the readings can be better defined and statistically evaluated.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A blind-rivet setting device, comprising:

a tension device, driven by an electric motor having an input current, for providing a tensile force on the blind-rivet;

an intermediate storage and computing device for storing and computing a rated current range depending on the material and dimensions of the blind-rivet;

an evaluation device having a comparator for monitoring said input current received by said electric motor; and an electrical circuit for producing an error message when the maximum value of said input current is not within said rated current range.

2. The blind-rivet setting device of claim 1, wherein said comparator is connected to a threshold value indicator which shows at least two pre-selected threshold values.

3. The blind-rivet setting device of claim 2, wherein at least one of a motor temperature measuring device for said motor and a motor voltage meter for said motor are provided with connections to said threshold value indicator which changes the pre-selected threshold value depending on at least one of the motor temperature and the motor input voltage.

4. The blind-rivet setting device of claim 3, wherein said threshold value indicator includes a storage device which stores various threshold values.

5. The blind-rivet setting device of claim 4, wherein said storage device is connected to a readout device which includes a peak current meter, an intermediate storage for storing at least one peak current, and a computing device for determining at least one of a mean value and a tolerance-band from said at least one doted peak current value.

6. The blind-rivet setting device of claim 1, wherein said comparator comprises a window comparator.

7. The blind-rivet setting device of claim 1, wherein a position-sensor for said tension device is provided and is connected to said evaluation device.

8. The blind-rivet setting device of claim 7, wherein said position-sensor comprises a limit switch.

* * * * *